US008136352B2

(12) United States Patent
Arai

(10) Patent No.: US 8,136,352 B2
(45) Date of Patent: Mar. 20, 2012

(54) COVER MEMBER FOR PLURAL EXHAUST PIPES

(75) Inventor: Nobuhiro Arai, Shizuoka (JP)

(73) Assignee: Yamaha Hatsudoki Kabushiki Kaisha, Iwata-Shi (JP)

( * ) Notice: Subject to any disclaimer, the term of this patent is extended or adjusted under 35 U.S.C. 154(b) by 980 days.

(21) Appl. No.: 11/929,280

(22) Filed: Oct. 30, 2007

(65) Prior Publication Data

US 2008/0110162 A1 May 15, 2008

(30) Foreign Application Priority Data

Oct. 31, 2006 (JP) ..... 2006-295416
Oct. 4, 2007 (JP) ..... 2007-260659

(51) Int. Cl.
*F01N 1/00* (2006.01)

(52) U.S. Cl. ..... 60/323; 60/320; 60/322; 181/282; 181/283

(58) Field of Classification Search ..... 60/274, 60/322, 323, 284–287
See application file for complete search history.

(56) References Cited

U.S. PATENT DOCUMENTS

| | | | | | |
|---|---|---|---|---|---|
| 4,604,865 | A * | 8/1986 | Otani et al. | 60/293 |
| 4,612,767 | A * | 9/1986 | Engquist et al. | 60/321 |
| 4,619,292 | A * | 10/1986 | Harwood | 138/113 |
| 4,656,712 | A * | 4/1987 | Harwood et al. | 29/890.08 |
| 4,673,052 | A * | 6/1987 | Shinozake et al. | 180/219 |
| 4,860,538 | A * | 8/1989 | Takeuchi | 60/313 |
| 4,909,530 | A * | 3/1990 | Tsukada et al. | 180/296 |
| 4,930,811 | A * | 6/1990 | Tsukada et al. | 280/834 |
| 5,010,731 | A * | 4/1991 | Onishi | 60/313 |
| 5,271,477 | A * | 12/1993 | Gekka et al. | 180/219 |
| 5,844,177 | A * | 12/1998 | Pirchl | 181/211 |
| 6,910,546 | B2 * | 6/2005 | Tsutsumi et al. | 180/219 |
| 7,048,201 | B2 * | 5/2006 | Kerchner et al. | 237/79 |
| 7,121,571 | B2 * | 10/2006 | Savage et al. | 280/291 |
| 7,290,533 | B2 | 11/2007 | Tsuruta et al. | |
| 2004/0083714 | A1 * | 5/2004 | Tsuruta | 60/272 |
| 2006/0219221 | A1 | 10/2006 | Tsuruta et al. | |
| 2007/0178024 | A1 * | 8/2007 | Sarda | 422/171 |

FOREIGN PATENT DOCUMENTS

| | | | |
|---|---|---|---|
| DE | 3333591 | A1 | 3/1985 |
| DE | 19738075 | A1 | 3/1999 |
| EP | 867605 | A1 * | 2/1997 |
| EP | 0867605 | A1 | 9/1998 |
| JP | 58015710 | A | 1/1983 |
| JP | 58104318 | A | 6/1983 |
| JP | 02249778 | A | 10/1990 |
| JP | 07-008524 | | 2/1995 |
| WO | WO 2005031130 | A1 * | 4/2005 |

OTHER PUBLICATIONS

European Search Report for corresponding European application No. 07254179.0.

* cited by examiner

*Primary Examiner* — Thomas Denion
*Assistant Examiner* — Jesse Bogue
(74) *Attorney, Agent, or Firm* — Rabin & Berdo, PC

(57) ABSTRACT

A vehicle that sufficiently insulates heat between plural exhaust pipes connected to an engine. A cover member bridges over and covers the periphery of the exhaust pipes. A thermal insulation member fills in a space on a line connecting centers of the exhaust pipes, and a space in the vicinity of the line.

14 Claims, 9 Drawing Sheets

[Fig. 3]
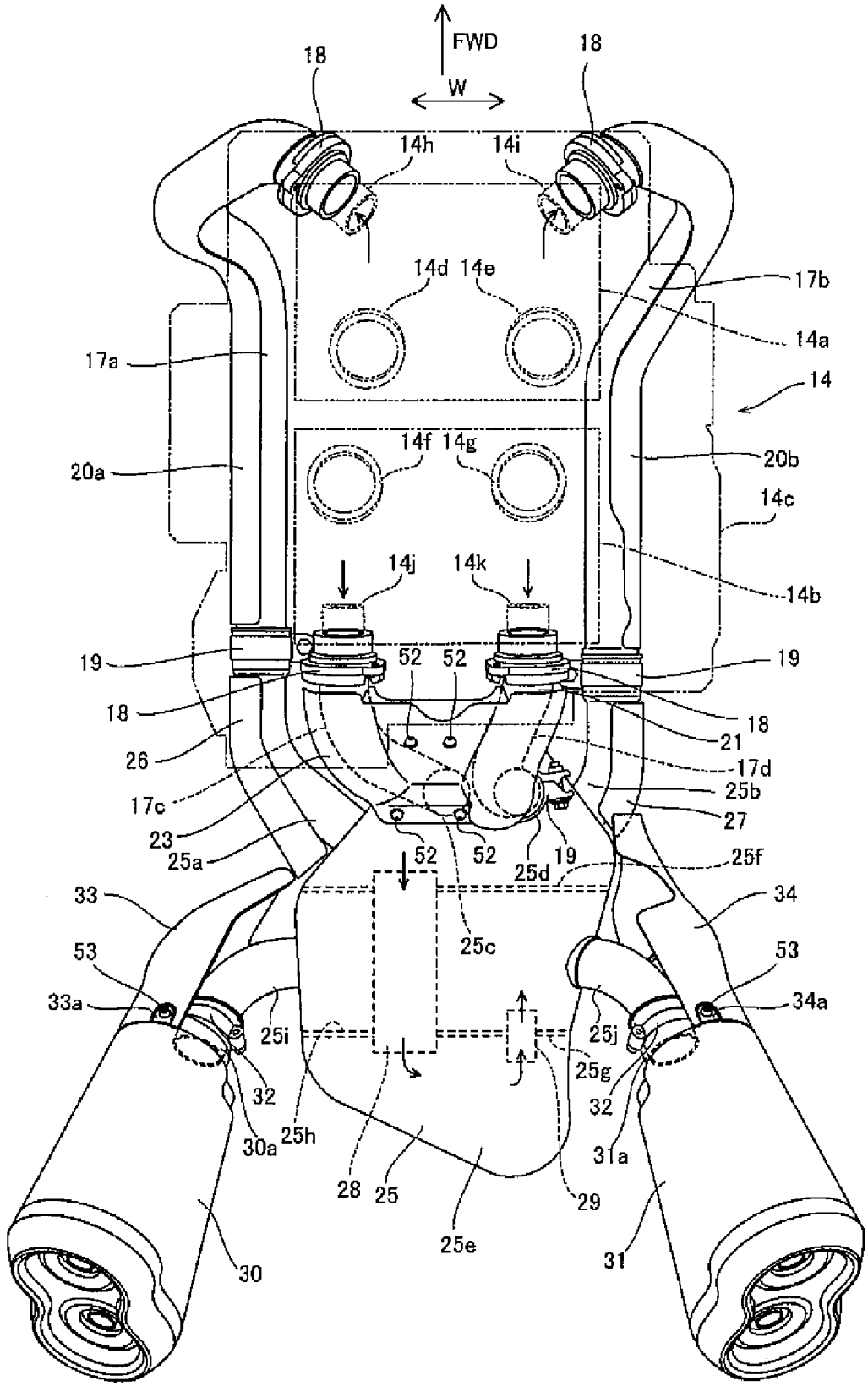

[Fig. 4]
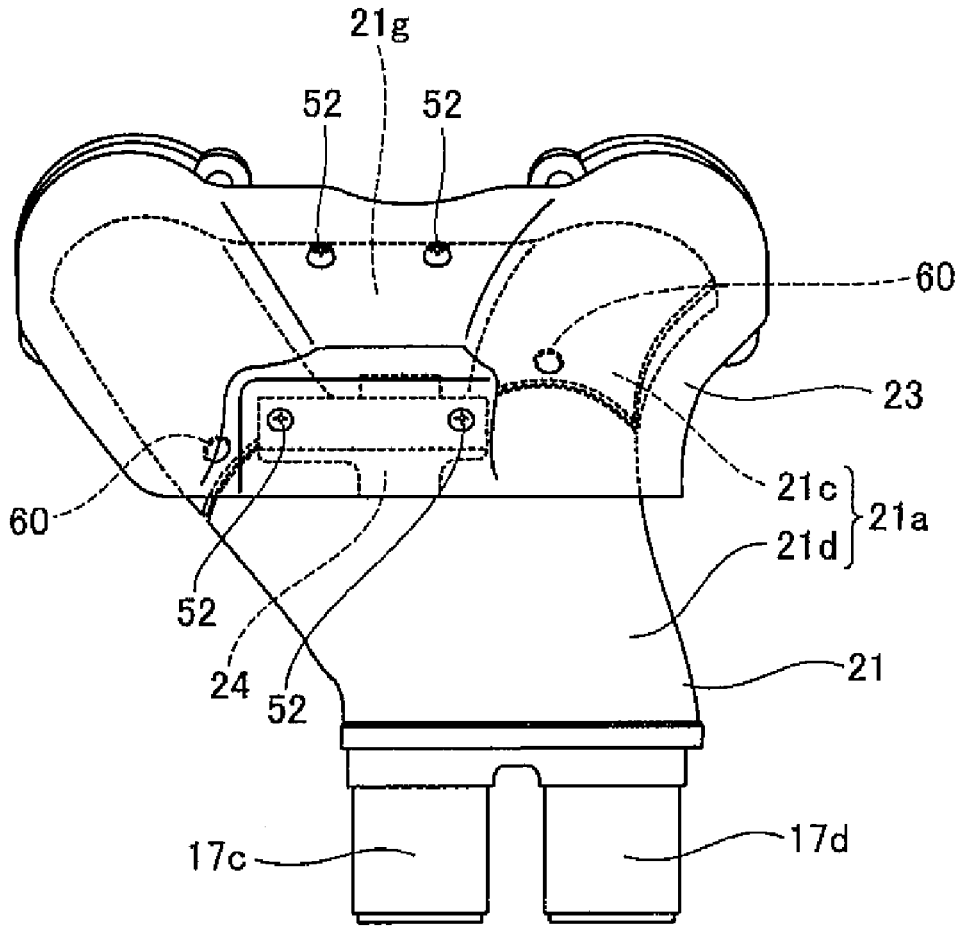

[Fig. 5]
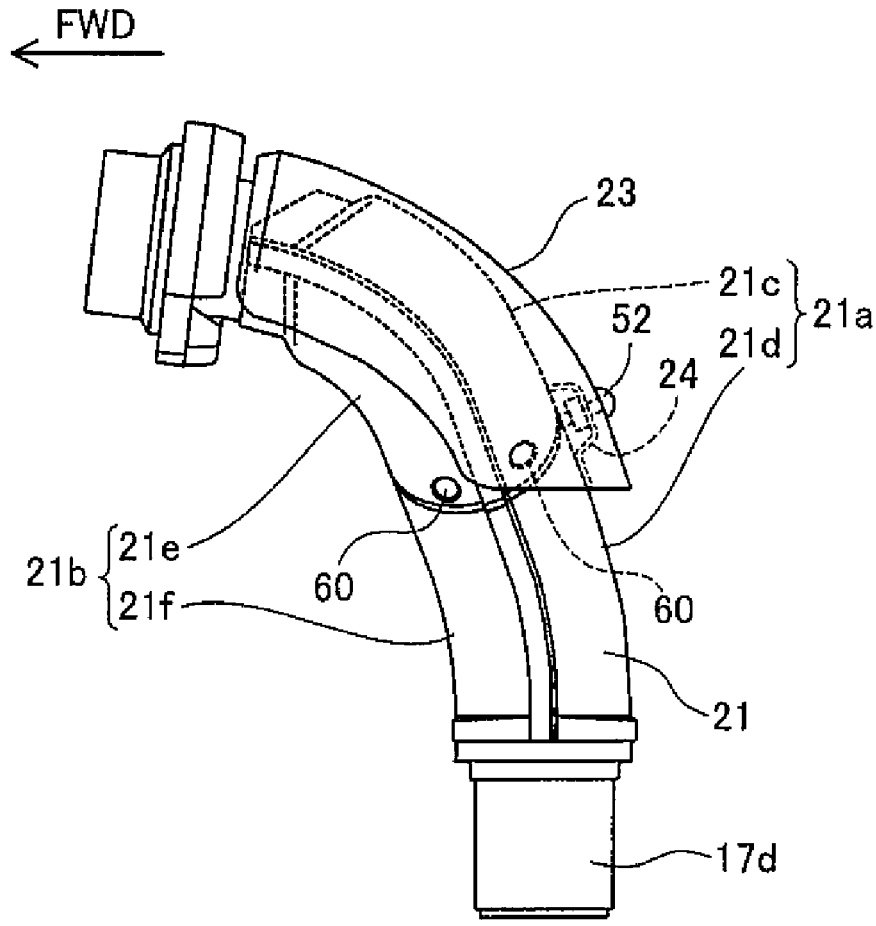

[Fig. 6]
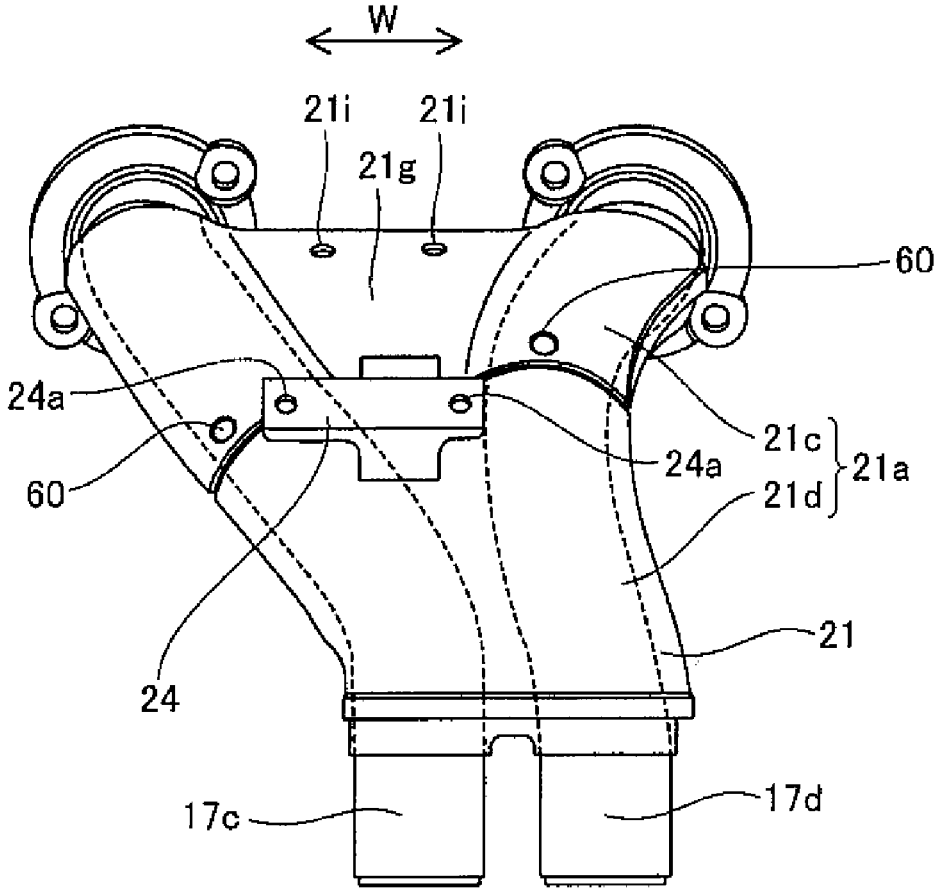

[Fig. 7]
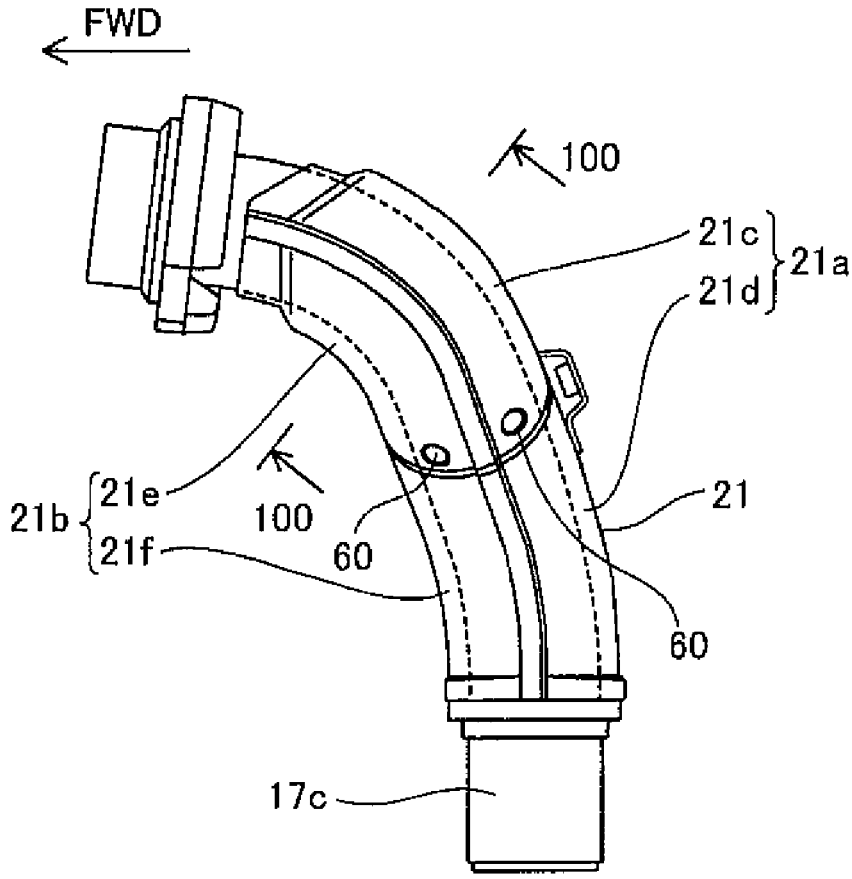

[Fig. 8]
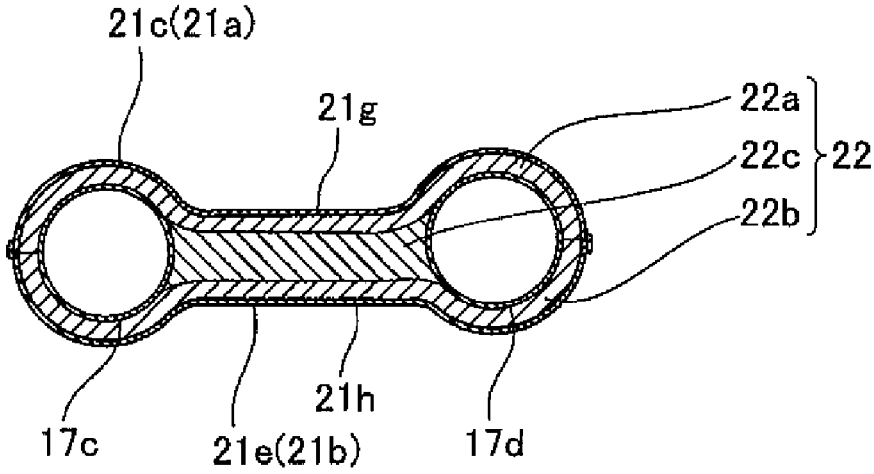

[Fig. 9]
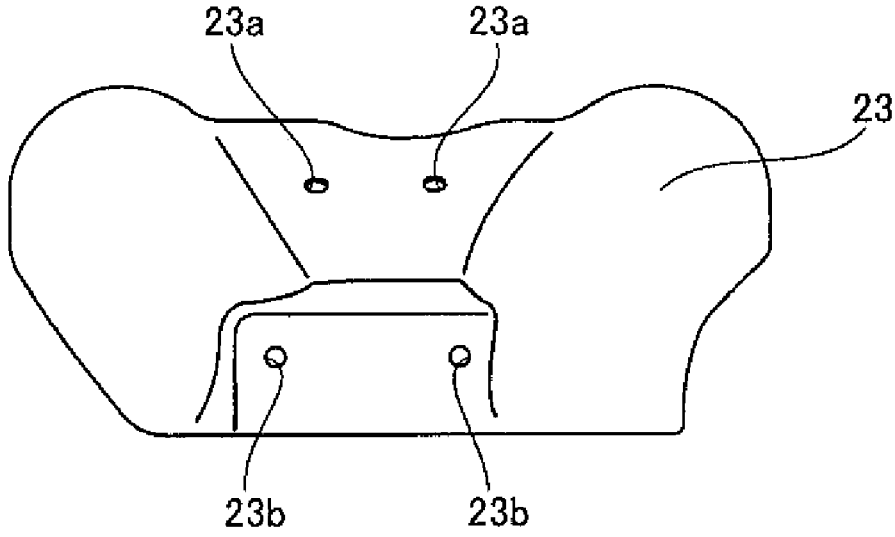

COVER MEMBER FOR PLURAL EXHAUST PIPES

RELATED APPLICATIONS

This application claims the benefit of priority under 35 USC 119 of Japanese patent application nos. 2006-295416, filed on Oct. 31, 2006, and 2007-260659, filed on Oct. 4, 2007, which applications are hereby incorporated by reference in their entireties.

BACKGROUND OF THE INVENTION

1. Field of the Invention

The invention relates to a vehicle, and particularly, to a vehicle including an exhaust pipe.

2. Description of Related Art

An exhaust pipe is conventionally used in a vehicle. JP-UM-A-H07-8524, for example, discloses an exhaust apparatus comprising two exhaust pipes connected to an inner combustion engine of an automobile or the like, an external pipe covering a periphery of the two exhaust pipes and a thermal insulation member such as glass wool. The thermal insulation member is provided along an inner surface of the external pipe while no insulation member is provided in an area on and in the vicinity of a centerline between the two exhaust pipes.

In JP-UM-A-H07-8524, however, a space with no thermal insulation member is formed on and in the vicinity of a centerline between two exhaust pipes. This causes a disadvantage in that heat generated from the two exhaust pipes escapes from the space with no thermal insulation member between the two exhaust pipes and a problem in that it is difficult to sufficiently insulate heat between the two exhaust pipes.

SUMMARY OF THE INVENTION

The invention solves this problem and provides a vehicle that sufficiently insulates heat between plural exhaust pipes.

A vehicle in accordance with one embodiment of the invention comprises an engine and plural exhaust pipes connected to the engine. A first cover member bridges over and covers a periphery of the plural exhaust pipes. A thermal insulation member fills in a space on a line connecting centers of the plural exhaust pipes and a space in the vicinity of the line.

In the vehicle in accordance with the invention, by providing a first cover member bridged over and covering a periphery of plural exhaust pipes, and a thermal insulation member filling in a space on a line connecting centers of the plural exhaust pipes and a space in the vicinity of the line, a space with no thermal insulation member is not formed between the plural exhaust pipes. This allows heat to be sufficiently insulated between the plural exhaust pipes.

In one embodiment, the thermal insulation member fills in a space inside the first cover member substantially with no space left. This structure suppresses vibration of the thermal insulation member with respect to the inner surface of the first cover member during running and thereby prevents the thermal insulation member from being crumbled to a powder. Accordingly, a space with no thermal insulation member is not formed between the exhaust pipes and the first cover member, so that heat of the exhaust pipes is sufficiently insulated.

In one embodiment, the first cover member includes a connection part for connecting the plural exhaust pipes, and the thermal insulation member fills in an inner part of the connection part This structure prevents a space with no thermal insulation member from being formed between the plural exhaust pipes inside the first cover member, even when the plural exhaust pipes are provided at intervals.

In one embodiment, the thermal insulation member includes a first insulation member provided along an inner surface of the first cover member, and a second insulation member that fills in a space inside a part of the first cover member bridged over the plural exhaust pipes. This structure allows the space inside the first cover member that is bridged over the plural exhaust pipes to be easily filled with the thermal insulation member formed from the first insulation member and the second insulation member.

In one embodiment, the first cover member includes an upper cover member provided on the upper side of the plural exhaust pipes and a lower cover member provided on the lower side of the plural exhaust pipes. By using the upper side cover member and the lower side cover member to put the plural exhaust pipes therebetween, the periphery of the plural exhaust pipes is covered easily.

In one embodiment, a fuel tank is disposed at a predetermined distance from the plural exhaust pipes. This effectively prevents the fuel tank from rising high in temperature by means of the first cover member that sufficiently insulates the heat of the exhaust pipes.

In one embodiment, a second cover member is provided between the plural exhaust pipes and the fuel tank. This structure further suppresses transmission of heat of the exhaust pipes to the fuel tank, so that the fuel tank is more effectively prevented from rising high in temperature.

In one embodiment, the first cover member includes a fitting part for fitting the second cover member. This structure allows the second cover member to be easily provided between the plural exhaust pipes and the fuel tank.

In one embodiment, the plural exhaust pipes are provided at respectively predetermined intervals. Accordingly, the space inside the first cover member is closely filled in with the thermal insulation member even when the plural exhaust pipes are provided at respectively predetermined intervals. This prevents the thermal insulation member from vibrating with respect to the inner surface of the first cover member due to vibration in running.

In this embodiment, the plural exhaust pipes provided at respectively predetermined intervals may be provided above at least a part of the engine. This structure prevents heat of the engine from passing through the plural exhaust pipes by means of the first cover member whose parts corresponding to spaces between the plural exhaust pipes are filled with the thermal insulation members. Accordingly, an upper part of the engine is prevented from rising high in temperature.

In one embodiment, a purification part is provided for purifying exhaust gas having passed through the plural exhaust pipes. In accordance with such a structure, the first cover member sufficiently insulating the heat of the exhaust pipes keeps the exhaust gas passing through the exhaust pipes at a state of high temperature. This allows the exhaust gas to flow into the purification part at an equal or higher temperature than the temperature activating the purification part (a catalyst), and results in improved efficiency in purification of the exhaust gas.

An expansion chamber connected to the plural exhaust pipes and the purification part may be provided in an inner part of the expansion chamber. Such a structure allows exhaust gas to flow into the purification part at a state of higher temperature than in the case that the purification part is provided inside a muffler connected on a downstream side of the expansion chamber. Accordingly, the exhaust gas flows into the purification part at a temperature higher than the temperature for activating the catalyst.

In the one embodiment the engine is formed from a V type engine including a front cylinder part and a rear cylinder part, the plural exhaust pipes include plural front cylinder side exhaust pipes connected to the front cylinder part and plural rear cylinder side exhaust pipes connected to the rear cylinder part, and the first cover member is bridged over at least the plural rear cylinder side exhaust pipes for covering a periphery of the plural rear cylinder side exhaust pipes. In accordance with such a structure, the fuel tank and a part of a body of a driver are generally provided in the periphery of the rear cylinder side exhaust pipes rather than the periphery of the front cylinder side exhaust pipes, so that the heat of the exhaust pipes is effectively prevented from being transmitted to the fuel tank and the part of a body of a driver.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

FIG. 3 is a plan view of a periphery of an engine of the motorcycle of FIG. 1.

FIG. 4 is a back view of a periphery of an exhaust pipe of the motorcycle of FIG. 1.

FIG. 5 is a side view of a periphery of an exhaust pipe of the motorcycle of FIG. 1.

FIG. 6 is a back view of a periphery of an exhaust pipe of the motorcycle of FIG. 1.

FIG. 7 is a side view of a periphery of an exhaust pipe of the motorcycle of FIG. 1.

FIG. 8 is a sectional view taken along line 100-100 of FIG. 7.

FIG. 9 is a back view of a cover member provided between an exhaust pipe and a fuel tank of the motorcycle of FIG. 1.

DETAILED DESCRIPTION OF THE INVENTION

An embodiment of the invention is now described on the basis of the drawings.

Figure 1:
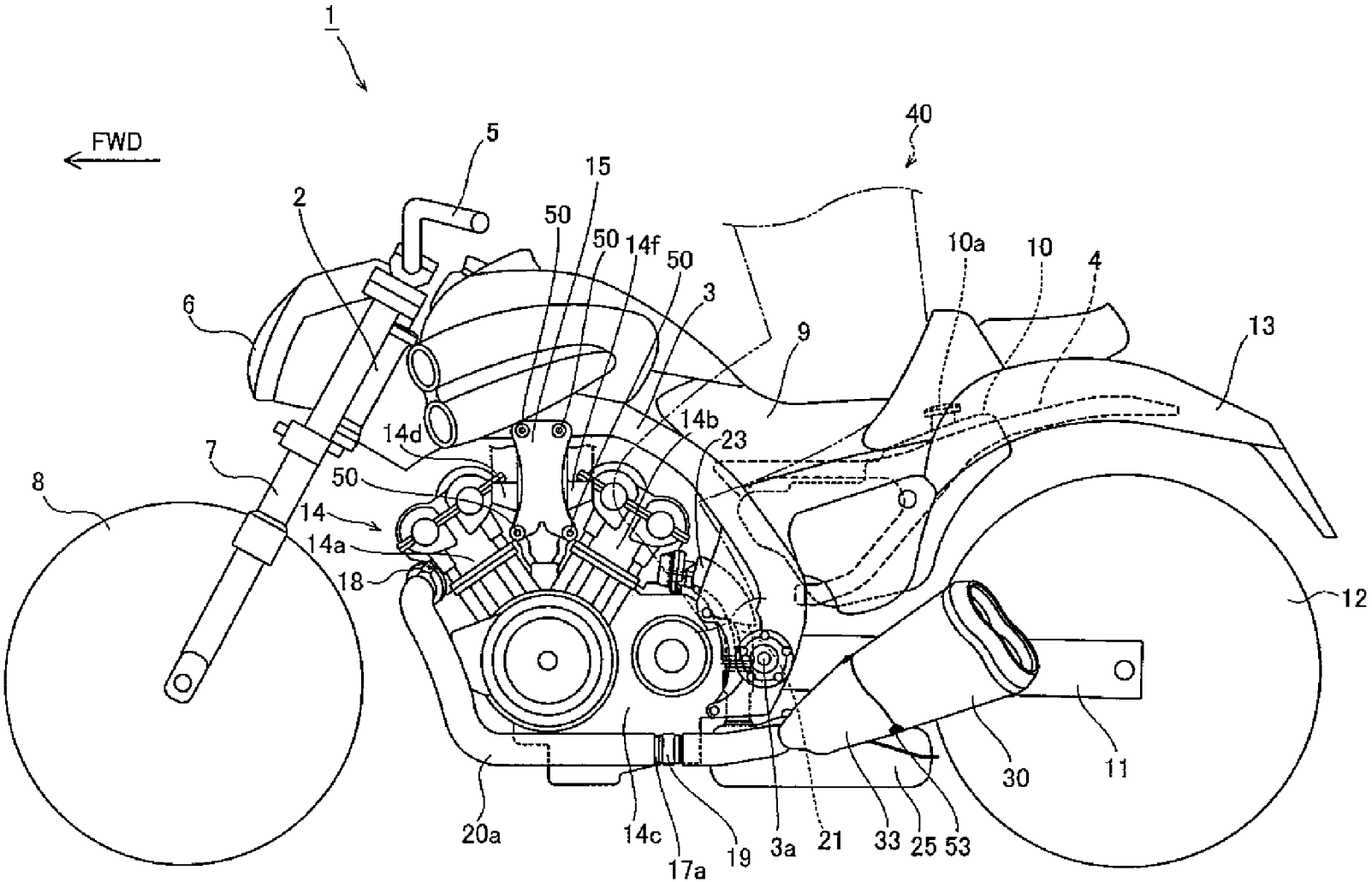
FIG. 1 is a side view of a motorcycle in accordance with an embodiment of the invention.

FIG. 1 is a side view of a motorcycle 1 in accordance with an embodiment of the invention. FIGS. 2-9 illustrate in detail a structure of the periphery of exhaust pipes of motorcycle 1 of FIG. 1, which is an example of a vehicle in accordance with the invention. In the drawings, an "FWD" direction means a forward direction in running of the motorcycle.

In motorcycle 1, a main frame 3 extends in a back and forth direction at the rear of a head pipe 2, as shown in FIG. 1. A rear frame 4 is connected at the rear of main frame 3 and extends rearward and upward. Head pipe 2, main frame 3 and rear frame 4 form a body frame.

A handle 5 is rotatably fitted to the upper part of head pipe 2. A front light 6 is provided in front of head pipe 2. A pair of front forks 7 having a suspension for absorbing shock in a vertical direction is provided below head pipe 2. A front wheel 8 is rotatably mounted to the lower ends of the pair of front forks 7.

A seat 9 is provided at the rear of main frame 3. A fuel tank 10 made of resin and having a fuel filling port 10*a* is provided below seat 9. A pivot shaft 3*a* at the rear end (a lower part) of main frame 3 holds a front end of a rear arm 11 so as to be able to swing vertically. A rear wheel 12 is rotatably mounted to a rear end of rear arm 11. A rear fender 13 covers the upper part of rear wheel 12.

Figure 2:
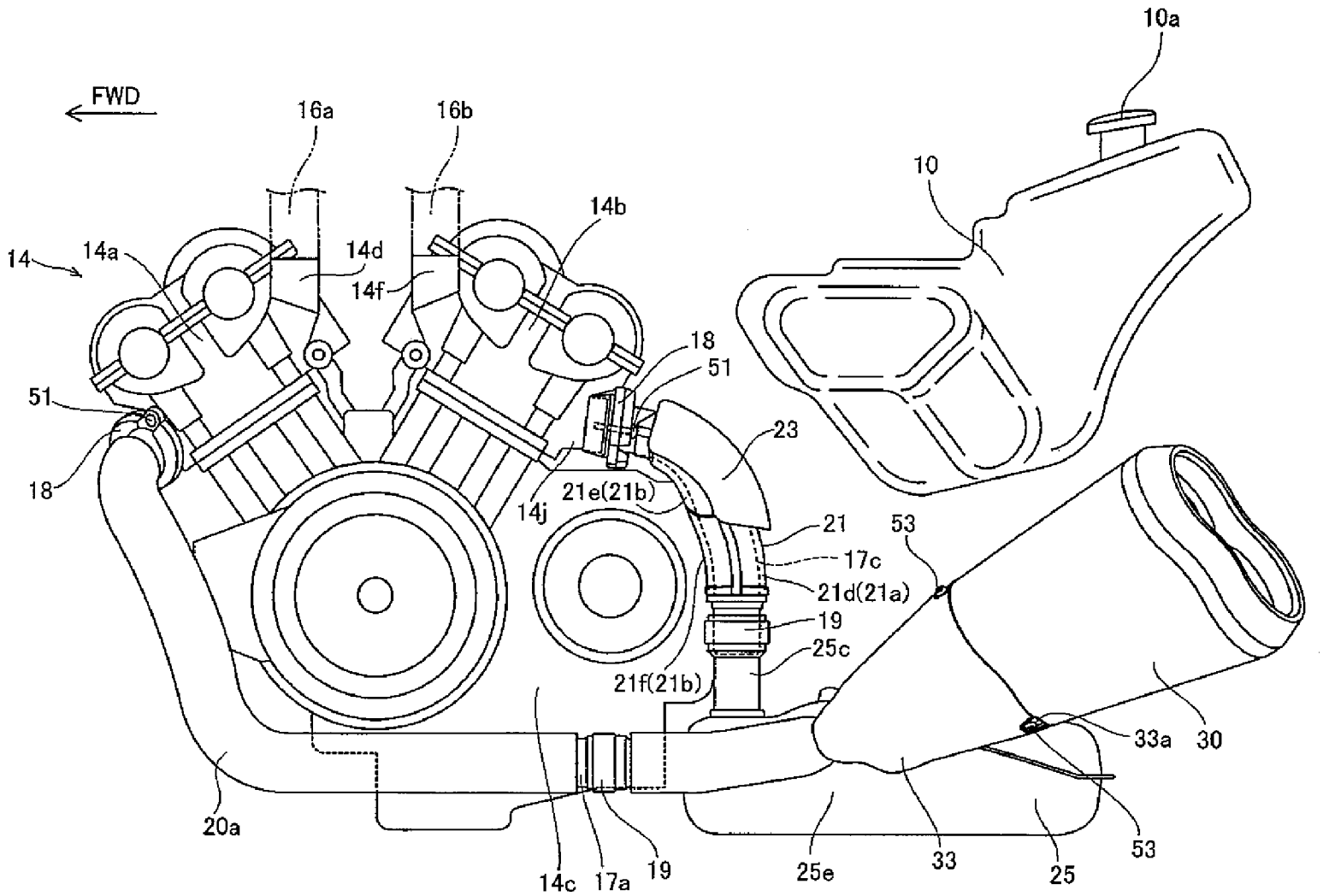
FIG. 2 is a side view of a periphery of an engine of the motorcycle of FIG. 1.

An engine 14 below main frame 3 is fixed to main frame 3 by means of a fixing member 15 and a screw 50. As shown in FIGS. 2 and 3, engine 14 has four cylinders and comprises a V-type engine having a cylinder case part 14*a* in which two front cylinders are provided, a cylinder case part 14*b* in which two rear cylinders are provided, and a crank case 14*c*. Cylinder case part 14*a* is an example of a "front cylinder part" of the invention. Cylinder case part 14*b* is an example of a "rear cylinder part" in the invention.

As shown in FIG. 3, intake side connection parts 14*d* and 14*e* extending upward are provided in front cylinder case part 14*a*. Intake side connection parts 14*f* and 14*g* extending upward are provided in rear cylinder case part 14*b*. Intake side connection parts 14*d* and 14*e* of front cylinder case part 14*a* are connected to two intake pipes 16*a* (FIG. 2). Intake side connection parts 14*f* and 14*g* of rear cylinder case part 14*b* are connected to two intake pipes 16*b* (FIG. 2).

Front cylinder case part 14*a* has an exhaust side connection part 14*h* extending forward on the left side and an exhaust side connection part 14*i* extending forward on the right side. Rear cylinder case part 14*b* has exhaust side connection parts 14*j* and 14*k* extending rearward. In this description, the "left" and "right" sides means left and right sides in a running (FWD) direction. Exhaust side connection parts 14*h* and 14*i* of front cylinder case part 14*a* are connected to metal exhaust pipes 17*a* and 17*b*. Exhaust side connection parts 14*j* and 14*k* of rear cylinder case part 14*b* are connected to metal exhaust pipes 17*c* and 17*d*. Fixing members 18 are provided at a connection part between exhaust side connection part 14*h* (FIG. 3) and exhaust pipe 17*a*, and at a connection part between exhaust side connection part 14*i* (FIG. 3) and exhaust pipe 17*b* (FIG. 3). Fixing members 18 are fixed to engine 14 by screws 51 (FIG. 2) to fix exhaust pipes 17*a* and 17*b* (FIG. 3) to exhaust side connection parts 14*h* and 14*i* (FIG. 3) of engine 14. Fixing members 18 are also provided at a connection part between exhaust side connection part 14*j* (FIG. 3) and exhaust pipe 17*c*, and at a connection part between exhaust side connection part 14*k* (FIG. 3) and exhaust pipe 17*d* (FIG. 3). Fixing members 18 are fixed to engine 14 by screws 51 (FIG. 2) to fix exhaust pipes 17*c* and 17*d* (FIG. 3) to exhaust side connection parts 14*j* and 14*k* (FIG. 3) of engine 14. Exhaust pipes 17*a* and 17*b* are examples of a "front cylinder side exhaust pipe" of the invention. Exhaust pipes 17*c* and 17*d* are examples of a "rear cylinder side exhaust pipe" of the invention.

Exhaust pipes 17*a* and 17*b* extend rearward and are connected to connection parts 25*a* and 25*b* of a chamber 25 by metal band members 19, as shown in FIG. 3. A metal cover member 20*a* covers the outside (left side) of exhaust pipe 17*a*, and a metal cover member 20*b* covers the outside (right side) of exhaust pipe l7*b*.

Exhaust pipes 17*c* and 17*d* are above the rear of crank case 14*c* of engine 14, as shown in FIGS. 2 and 3, and are downward in the front of resin fuel tank 10 at a predetermined distance. Further, as shown in FIGS. 3 and 4, exhaust pipes 17*c* and 17*d* are provided at a predetermined distance from each other in the width (W) direction of the vehicle body. The feet of a driver 40 riding motorcycle 1 are provided on the sides of and above exhaust pipes 17*c* and 17*d*, at a predetermined distance from exhaust pipes 17*c* and 17*d*, as shown in FIG. 1.

As shown in FIG. 6, a metal cover member 21 covers the periphery of and is mounted to exhaust pipes 17*c* and 17*d* so as to be bridged over exhaust pipes 17*c* and 17*d*. Cover member 21 has an upper cover member 21*a* provided on the upper side of exhaust pipes 17*c* and 17*d* and a lower cover member 21*b* (FIG. 7) provided on the lower side of exhaust pipes 17*c* and 17*d*, which are welded together, as shown in FIGS. 6 and 7. Upper cover member 21*a* is formed from a front cover member 21*c* and a rear cover member 21*d*, which are spot-welded by means of weld metal 60. Lower cover member 21*b* is formed form a front cover member 21*e* and a rear cover member 21*f*, which are spot-welded by means of weld metal 60, as shown in FIG. 7. Cover member 21 is an example of a "first cover member" of the invention. Putting exhaust pipes 17*c* and 17*d* between upper cover member 21*a* and lower cover member 21*b* allows the periphery of exhaust pipes 17*c* and 17*d* (FIG. 6) to be covered. Furthermore, as shown in FIG. 8, connection parts 21*g* and 21*h* for connecting exhaust pipes 17*c* and 17*d* are respectively formed in upper cover member 21*a* and lower cover member 21*b*.

A thermal insulation member 22 made of glass wool for closely substantively filling a space inside cover member 21 is provided in cover member 21. Thermal insulation member 22 is formed from an upper insulation member 22*a* provided along an inner surface of upper cover member 21*a*, a lower insulation member 22*b* provided along an inner surface of lower cover member 21*b* and a middle insulation member 22*c* provided so as to fill a space inside a part bridged over exhaust pipes 17*c* and 17*d* of cover member 21 (connection parts 21*g* and 21*h*). Upper insulation member 22*a* and lower insulation member 22*b* are examples of a "first insulation member" of the invention. Middle insulation member 22*c* is an example of a "second insulation member" of the invention.

Thus, upper insulation member 22*a* and lower insulation member 22*b* closely fill in a space between cover member 21 and exhaust pipes 17*c* and 17*d*, and middle insulation member 22*c* fills in a space on a line L connecting a center CT of exhaust pipe 17*c* and a center C2 of exhaust pipe 17*d* and a space in the vicinity of line L connecting center C1 and center C2 with no space left.

As shown in FIG. 2, a metal cover member 23 is provided between cover member 21 (exhaust pipes 17*c* and 17*d*) and fuel tank 10. Cover member 23 is an example of a "second cover member" of the invention. As shown in FIGS. 4 and 5, cover member 23 is fixed to cover member 21 by means of screw holes 23*a* and 23*b* (FIG. 9), which are fixed to screw holes 21*i* (FIG. 6) of upper cover member 21*a* and screw holes 24*a* (FIG. 6) of a holding member 24 welded to upper cover member 21*a* by means of screws 52. Cover member 23 covers the upper part and side parts of cover member 21 (exhaust pipes 17*c* and 17*d*). Screw holes 21*i* are an example of a "fitting part" of the invention.

Exhaust pipes 17*c* and 17*d* extend downward to the rear side as well as being connected to connection parts 25*c* and 25*d* of chamber 25 by metal band members 19. Chamber 25 expands exhaust gas from engine 14 (exhaust pipes 17*a* to 17*d*) to reduce exhaust sound. Chamber 25 is an example of an "expansion chamber" of the invention.

As shown in FIG. 3, connection part 25*a* extending forward on the left side, connection part 25*b* extending forward on the right side and the two connection parts 25*c* and 25*d* extending upward are provided in a main body part 25*e* of chamber 25. A left cover member 26 and a right cover member 27, which are made of metal are respectively fitted to connection parts 25*a* and 25*b* to cover the sides of connection parts 25*a* and 25*b*.

Main body part 25*e* is formed from a first expansion chamber 25*f* in which connection parts 25*a* to 25*d* are provided, a second expansion chamber 25*g* provided on the rear of main body part 25*e*, and a third expansion chamber 25*h* provided between first expansion chamber 25*f* and second expansion chamber 25*g*. A purification cylinder part 28 for connecting first expansion chamber 25*f* and second expansion chamber 25*g* is provided in main body part 25*e*. Purification cylinder part 28 is an example of a "purification part" of the invention and purifies exhaust gas having passed through exhaust pipes 17*a* to 17*d*. Purification cylinder part 28 includes a catalyst that oxidizes HC (hydrocarbon) and CO (carbon monoxide), which are the fuels left without burning, into $H_2O$ (water) and $CO_2$ (carbon dioxide), and that deoxidizes $NO_x$ (nitrogen oxide). A reverse cylinder part 29 for connecting second expansion chamber 25*g* and third expansion chamber 25*h* is also provided in main body part 25*e*.

Third expansion chamber 25*h* has a connection part 25*i* extending rearward on the left side and a connection part 25*j* extending rearward on the right side. Connection parts 25*i* and 25*j* are connected to a connection part 30*a* of a left muffler 30 and a connection part 31*a* of a right muffler 31, respectively, by means of metal band members 32.

A left metal cover member 33 is provided on the periphery of a connection part between chamber 25 and left muffler 30, and a right metal cover member 34 is provided on the periphery of a connection part between chamber 25 and right muffler 31. Left cover member 33 has a screwed part 33*a* at the rear end thereof to be screwed to left muffler 30 by a screw 53. Right cover member 34 has a screwed part 34*a* at the rear end thereof to be screwed to right muffler 31 by a screw 53.

As described above in this embodiment) cover member 21 bridges over and covers the periphery of exhaust pipes 17*c* and 17*d*, and thermal insulation member 22 fills in a space on line L connecting center C1 of exhaust pipe 17*c* and center C2 of exhaust pipe 17*d* and a space in the vicinity of line L connecting center C1 and center C2. This prevents formation of a space without thermal insulation member 22 from being formed between exhaust pipes 17*c* and 17*d*, and sufficiently insulates heat between exhaust pipes 17*c* and 17*d*.

In this embodiment, as described above, thermal insulation member 22 fills in a space inside cover member 21 substantially with no space left. This suppresses vibration of thermal insulation member 22 with respect to the inner surface of cover member 21 during running of motorcycle 1 so that thermal insulation member 22 is not crumbled to a powder. Accordingly, a space without thermal insulation member 22 is not formed between exhaust pipes 17*c* and 17*d* and cover member 21, and the heat of exhaust pipes 17*c* and 17*d* is sufficiently insulated.

Further, in this embodiment, thermal insulation member 22 is formed from upper insulation member 22*a* provided along an inner surface of upper cover member 21*a*, a lower insulation member 22*b* provided along an inner surface of lower cover member 21*b*, and middle insulation member 22*c* provided so as to fill a space in a part bridged over exhaust pipes 17*c* and 17*d* of cover member 21. Accordingly, the space in cover member 21 bridged over exhaust pipes 17*c* and 17*d* is easily and closely filled with thermal insulation member 22 comprising upper insulation member 22*a*, lower insulation member 22*b* and middle insulation member 22*c*.

Moreover, in this embodiment, cover member 21 is formed from upper cover member 21*a* provided on the upper side of exhaust pipes 17*c* and 17*d* and lower cover member 21*b* provided on the lower side of exhaust pipes 17*c* and 17*d*. Thus, by using upper cover member 21*a* and lower cover member 21*b* to put exhaust pipes 17*c* and 17*d* therebetween, the periphery of exhaust pipes 17*c* and 17*d* is easily covered.

In addition, in this embodiment, when resin fuel tank 10 and the feet of driver 40 are provided at a predetermined distance from exhaust pipes 17*c* and 17*d* (cover member 21), cover member 21 sufficiently insulates the heat of exhaust pipes 17*c* and 17*d* and effectively prevents resin fuel tank 10 and the feet of driver 40 from rising high in temperature.

Furthermore, in this embodiment, providing cover member 23 between exhaust pies 17*c* and 17*d* (cover member 21) and resin fuel tank 10 further suppresses transmission of heat of exhaust pipes 17*c* and 17*d* to resin fuel tank 10, and more effectively prevents resin fuel tank 10 from rising high in temperature.

In this embodiment, exhaust pipes 17*c* and 17*d* are provided above the rear of crank case 14*c* of engine 14. Accordingly, cover member 21 and cover member 23, a part of cover member 21 corresponding to a gap between exhaust pipes 17*c* and 17*d* being filled with thermal insulation member 22, prevent the heat of engine 14 from passing upward through exhaust pipes 17*c* and 17*d*, which are provided at a predetermined distance from each other. This prevents resin fuel tank 10 above engine 14 and the feet of driver 40 from rising high in temperature.

Moreover, in this embodiment, purification cylinder part 28 purifies exhaust gas having passed through exhaust pipes 17*c* and 17*d*. Exhaust gas flows into purification cylinder part 28 at an equal or higher temperature than the activation temperature of purification cylinder part 28 (the catalyst) since the exhaust gas passing through exhaust pipes 17*c* and 17*d* is kept at high temperature by cover member 21, which insulates the heat of exhaust pipes 17*c* and 17*d*. This improves purification efficiency.

The embodiment described herein is only exemplary and is not limiting. The range of the invention is indicated not by this description but by the claims, which cover various equivalents and modifications.

For example, while a motorcycle has been described as including the exhaust pipes of this embodiment, the invention is not so limited. The invention is applicable to other vehicles having exhaust pipes, such as an automobile, a bicycle, a tricycle and an ATV (an all terrain vehicle).

Further, cover member 21 is has been described as bridging over and covering the periphery of two exhaust pipes 17*c* and 17*d*. Cover member 21 may instead be arranged, for example, to bridge and cover the periphery of three or more exhaust pipes.

In the embodiment, cover member 23 is described as being provided between exhaust pipes 17*c* and 17*d* (cover member 21) and fuel tank 10 is fixed to cover member 21. The invention, however, is not limited to the above. It may be possible to fix the cover member provided between exhaust pipes 17*c* and 17*d* (cover member 21) and fuel tank 10 on fuel tank 10 side or to provide two cover members between exhaust pipes 17*c* and 17*d* (cover member 21) and fuel tank 10 to fix one cover member to cover member 21 while fixing the other cover member on the fuel tank 10 side.

Moreover, cover member 23 is described as being provided between exhaust pipes 17*c* and 17*d* (cover member 21) and fuel tank 10. The invention, however, is not so limited. Cover member 23 may not be provided between exhaust pipes 17*c* and 17*d* (cover member 21) and fuel tank 10.

Furthermore, cover member 21 is described as bridging over and covering the periphery of exhaust pipes 17*c* and 17*d* at the rear cylinder case part 14*b* of engine 14. The invention, however, is not so limited. A cover member may also bridge over and cover the periphery of exhaust pipes 17*a* and 17*b* connected to front cylinder case part 14*a* of engine 14.

In addition, the first thermal insulation member is described as being formed from two of the upper insulation member 22*a* and the lower insulation member 22*b*. The invention, however, is so not limited. The first thermal insulation member may be formed from only one insulation member or from three or more insulation members.

The invention claimed is:

1. A vehicle comprising:

an engine;

plural exhaust pipes connected to the engine and including a first exhaust pipe and a second exhaust pipe having an area therebetween, all of the plural exhaust pipes being disposed outside of said area;

a first cover member bridged over the plural exhaust pipes and covering a periphery of the plural exhaust pipes;

a second cover member provided between the plural exhaust pipes and a fuel tank, and covering an upper part and side parts of the first cover member, the second cover member including an area cover portion covering said area so as to not cover any of the plural exhaust pipes, the second cover member being larger in a width direction of the vehicle than the first cover member; and a thermal insulation member filling in a space on a line connecting centers of the respective plural exhaust pipes and a space in the vicinity of the line.

2. The vehicle according to claim 1, wherein the thermal insulation member fills in a space inside the first cover member substantially with no space left.

3. The vehicle according to claim 1, wherein the first cover member includes a connection part for connecting the plural exhaust pipes; and the thermal insulation member fills in an inner part of the connection part.

4. The vehicle according to claim 1, wherein the thermal insulation member comprises a first insulation member provided along an inner surface of the first cover member and a second insulation member that fills in a space inside a part of the first cover member bridged over the plural exhaust pipes.

5. The vehicle according to claim 1, wherein the first cover member includes an upper cover member provided on the upper side of the plural exhaust pipes and a lower cover member provided on the lower side of the plural exhaust pipes.

6. The vehicle according to claim 1, further comprising:

a fuel tank provided at a predetermined distance from the plural exhaust pipes.

7. The vehicle according to claim 1, wherein the first cover member includes a fitting part for fitting the second cover member.

8. The vehicle according to claim 1, wherein the plural exhaust pipes are provided at respectively predetermined intervals.

9. The vehicle according to claim 8, wherein the plural exhaust pipes are provided above at least a part of the engine.

10. The vehicle according to claim 1, further comprising:

a purification part for purifying exhaust gas having passed through the plural exhaust pipes.

11. The vehicle according to claim 10, further comprising:

an expansion chamber connected to the plural exhaust pipes, and wherein the purification part is provided in an inner part of the expansion chamber.

12. The vehicle according to claim 1, wherein the engine is a V type engine including a front cylinder part and a rear cylinder part, the plural exhaust pipes include plural front cylinder side exhaust pipes connected to the front cylinder part and plural rear cylinder side exhaust pipes connected to the rear cylinder part, and the first cover member is bridged over at least the plural rear cylinder side exhaust pipes for covering a periphery of the plural rear cylinder side exhaust pipes.

13. The vehicle according to claim 1, wherein the second cover member is fixed to the first cover member at said area.

14. The vehicle according to claim 1, wherein the plural exhaust pipes have a portion uncovered by the first cover member, and the second cover member has a member covering portion covering the first cover member and a plural exhaust covering portion covering said portion of the plural exhaust pipes that is uncovered by the first cover member.

* * * * *